US005445262A

United States Patent [19]

Sutherland

[11] Patent Number: 5,445,262

[45] Date of Patent: Aug. 29, 1995

[54] BOTTLE CARRIER

[75] Inventor: Robert L. Sutherland, Kennesaw, Ga.

[73] Assignee: Riverwood International Corporation, Atlanta, Ga.

[21] Appl. No.: 84,670

[22] Filed: Jun. 29, 1993

[51] Int. Cl.[6] ..... B65D 71/00

[52] U.S. Cl. ..... 206/148; 206/152; 206/158; 206/199; 294/87.2

[58] Field of Search ..... 206/145, 147, 148, 149, 206/150, 151, 152, 153, 158, 161, 199, 427, 434; 294/87.2

[56] References Cited

U.S. PATENT DOCUMENTS

| | | | |
|---|---|---|---|
| 3,123,213 | 3/1964 | Kulig | 206/158 |
| 3,764,001 | 10/1973 | Graser | 206/148 |
| 3,834,750 | 9/1974 | Gauntlett | 206/148 X |
| 4,736,977 | 4/1988 | Killy | 206/158 X |

FOREIGN PATENT DOCUMENTS

| | | |
|---|---|---|
| 2069446 | 8/1981 | United Kingdom . |
| 1604840 | 12/1981 | United Kingdom . |

*Primary Examiner*—Paul T. Sewell
*Assistant Examiner*—Jacob K. Ackun, Jr.

[57] ABSTRACT

A bottle carrier of the type which supports bottles by tabs contacting the underside of shoulders on the bottles. An upper support panel and lower support panel flaps containing aligned bottle neck openings are spaced apart at one end by connected side panels and are in contact at their other ends. The edge portions adjacent the side panels function as reinforcing ribs. The tabs are of such shape and size as to accommodate the bowing that takes place when the carrier is lifted. Additional flaps may be provided to form two-ply lower support panel flaps and side panels, and to provide reinforcement strips beneath the upper support panel.

13 Claims, 3 Drawing Sheets

BOTTLE CARRIER

FIELD OF THE INVENTION

This invention relates to bottle carriers of the type that employ foldable tabs to engage the underside of shoulders on the bottles. More particularly, it relates to carriers of this type which are reinforced to provide greater strength.

BACKGROUND OF THE INVENTION

Beverage bottles are conventionally formed with a flange or shoulder that projects out from the neck. One type of carrier that has been designed to support such bottles in a simple economical manner employs so-called starburst support tabs spaced about bottle neck openings in a carrier support panel. When the panel is pushed down over bottles aligned with the. neck openings, the tabs are pivoted up so that their edges engage the underside of the bottle shoulders. A handle, usually in the form of finger holes in the panel, enables a person to grasp and lift the carrier its supported bottles.

While this basic design is functional with relatively lightweight bottles, it generally needs to be strengthened to enable it to resist tearing or excessive downward bowing when subjected to severe lifting and carrying stresses. Various means have been suggested to reinforce carriers of this type in order to strengthen the support panel, including the use of additional plies of material to protect against tearing° Although such measures provide additional protection against tearing of the panel, particularly in the handle area, they still do not adequately distribute lifting and carrying stresses under heavy loads.

It is therefore an object of the invention to provide a bottle support carrier which is capable of supporting heavy loads without tearing while retaining the simplicity and economy of the basic support tab design.

BRIEF SUMMARY OF THE INVENTION

The invention is directed to a carrier for supporting two rows of bottles, each bottle having a neck portion which includes an outwardly projecting shoulder. The carrier includes opposite side panels connected along fold lines to an upper support panel and to lower support panel flaps. Support tabs having edges for engaging the underside of the bottle shoulders are connected to the upper support panel by fold lines extending along portions of the periphery of the bottle neck openings in the upper support panel.

Both the upper support panel and the lower support panel flaps contain openings through which the necks of the bottles extend, and the end portions of the lower support panel flaps are in contact with the upper support panel between the rows of bottles. This arrangement results in the side panel and adjacent portions of the upper panel and lower support panel flaps functioning as reinforcing ribs which can readily withstand the lifting and carrying stresses distributed to them. The upward bowing of the support panel which normally occurs when lifting the carrier causes the bottle support tabs to push up against the bottle shoulders with greater force, thereby increasing the locking pressure on the bottles.

The formation of the reinforcing rib structure is preferably facilitated by providing a fold line between each side panel and the adjacent row of openings in the upper support panel. Also, the lower support panel flaps may include a fold line between each side panel and the adjacent row of openings. In both cases the fold lines are substantially parallel to the side panels.

The carrier may be further strengthened by making some or all of the main carrier elements of two-ply construction. Thus the support panel flaps may be comprised of an upper ply and a lower ply, with the lower ply being connected to the side panels and the upper ply being connected to the lower ply along a fold line extending substantially parallel to the side panels. The side panels may be comprised of an outer ply and an inner ply, with the outer ply being connected to both the upper support panel and the lower ply of the associated lower support panel flap and the inner ply being connected to the upper ply of the associated lower panel flap along a fold line substantially parallel to the side panels. In addition, the upper support panel may be reinforced by reinforcing strips connected along fold lines to the inner plies of the side panels and underlying the upper support panel. The reinforcing strips are provided with bottle openings aligned with the bottle openings in the upper support panel, and may also include support tabs for engaging the underside of the bottle shoulders.

In another aspect of the invention, adjacent support tabs of each bottle opening in the upper support panel are of different size or shape so as to accommodate the bowing of the upper support panel while remaining in supporting contact with the bottle shoulders. When reinforcing strips are employed, the support tabs of the aligned bottle openings in the reinforcing strips may be similar in size and shape to the support tabs of the upper support panel but angularly offset from the tabs of similar size and shape in order to ensure that substantially the entire circumference of the bottle shoulders are engaged by support tabs.

The carrier is formed from a single blank of substantially rectangular shape which is economical to produce and can readily be applied to form a package of bottles.

The features of the invention which enable it to provide the desired results are brought out in more detail in the description of the preferred embodiments, wherein the above and other aspects and benefits of the invention will be apparent.

BRIEF DESCRIPTION OF THE DRAWING

FIG. 7 is an end view similar to that of FIG. 4, but showing the modified carrier instead.

DETAILED DESCRIPTION OF THE PREFERRED EMBODIMENTS

Figure 1:
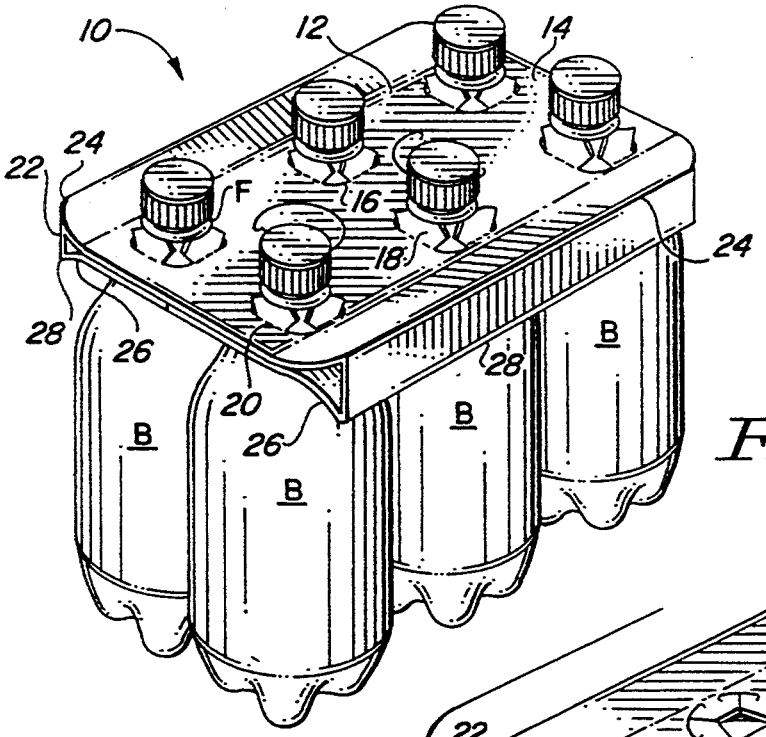
FIG. 1 is a pictorial view of one embodiment of the carrier of the invention.

Referring to FIG. 1, the package 10 is comprised of two rows of three bottles B and a carrier 12 for lifting and carrying the bottles. The carrier includes an upper support panel 14 with openings 16 through which the necks of the bottles extend. The end edges of tabs 18, which are connected to the panel 14 by fold lines 20 extending about the periphery of the bottle neck openings 16, contact the underside of the flanges F on the bottles to support the bottles when the carrier is lifted. The upper support panel 14 is connected to side panels 22 by fold lines 24, and lower support panel flaps 26 are connected to the side panels by fold lines 28. The outer edge portions of the upper support panel 14 extend up to the side panels 22 from the interior flat portion of the panel, while the outer edge portions of the lower support panel flaps 26 extend down to the side panels. Finger holes 30 in the support panel 14 function as a handle to allow a user to lift the carrier.

Figure 2:
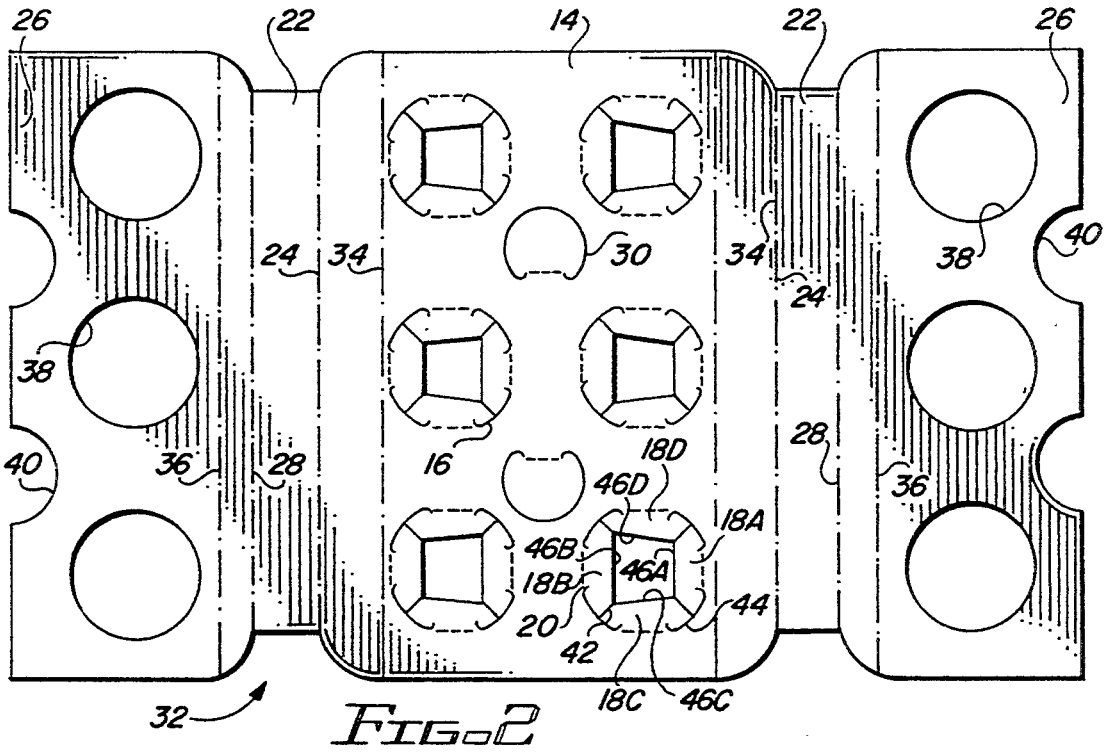
FIG. 2 is a plan view of a blank for forming the carrier of FIG. 1.

A blank for forming the carrier of FIG. 1 is shown in FIG. 2, wherein like reference numerals to those used in FIG. 1 denote similar elements. The blank is preferably formed of paperboard, but may be of any suitable material having sufficient strength and flexibility to function in the manner of paperboard. The blank 32 is comprised of a central section 14 corresponding to the upper support panel of the carrier, and two outer flap sections 26 corresponding to the lower support panel flaps of the carrier. Spaced from and parallel to the fold lines 24 are fold lines 34 in the support panel section 14. Fold lines 36 are provided in the support panel flaps 26 a short distance from and parallel to the fold lines 28. Each support panel flap contains three bottle neck openings 38 adapted to be aligned with the three nearest bottle neck openings 16 in a carrier formed from the blank. The support panel flaps also include semi-circular cutouts 40 at the outer edge of the flap sections which are adapted to be aligned with the nearest half of the finger holes 30 in the carrier. As in all support carriers, the diameter of the bottle openings 16 in the upper support panel 14 is related to the diameter of the neck portion of the bottles to be packaged so that the shoulder of the bottle neck is able to pass through the opening while contacting the support tabs to pivot them up about their fold lines. The diameter of the bottle openings 38 in the lower support panel flaps 26 must also be related to the diameter of the neck portion of the bottles so that the transition area of the bottle between the neck and the barrel will contact the bottle opening edges at a certain point, as explained below.

The support tabs 18 comprise four contiguous tabs arranged so that the fold lines of one pair of opposite tabs 18A and 18B are parallel to the side panel fold line 24 and coincide with the fold lines 34, while the fold lines of the other pair of opposite tabs 18C and 18D are at right angles to the fold line 24. The tabs are separated by slits 42 extending at 45° to the fold line 24, and are separated from the support panel section 14 from one tab fold line to the next by arcuate slits 44. The height of the tab 18A, as measured by the distance from the edge 46A of the tab to its fold line 20, is greater than the height of the opposite tab 18B. This results in the tab edge 46A being shorter than the tab edge 46B. Since the angle of the slits 42 is not changed, the edges 46C and 46D of the tabs 18C and 18D are angled with respect to the fold lines of the tabs.

Figure 3:
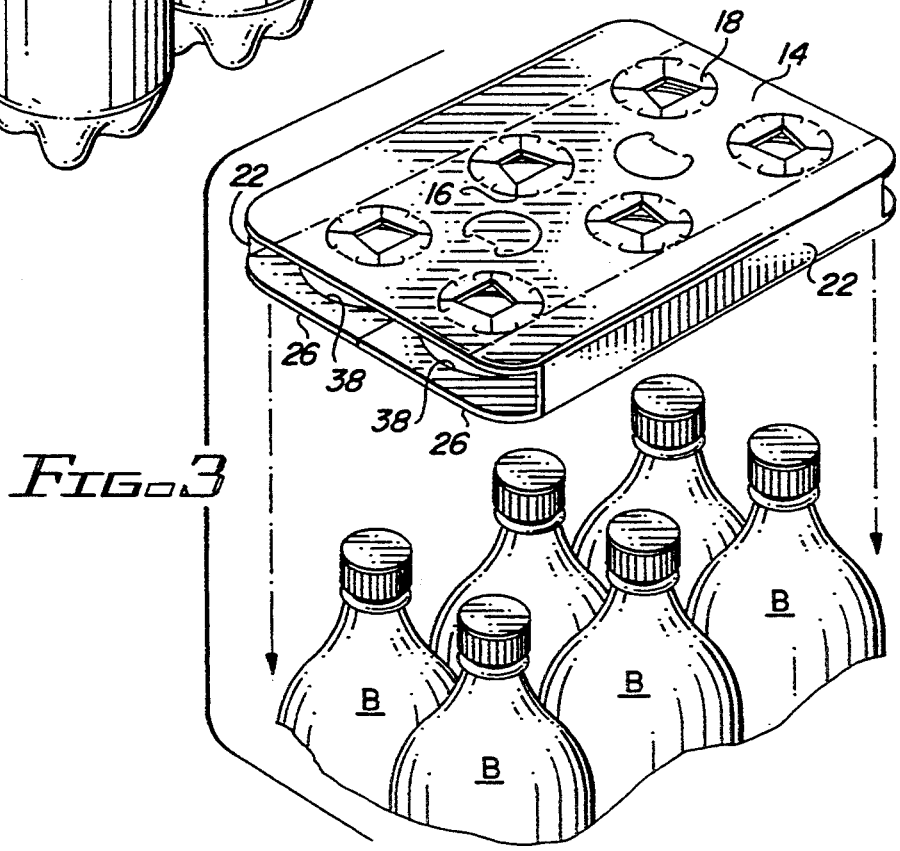
FIG. 3 is a pictorial view of the bottles and folded carrier blank, with the blank in position to be lowered into place on the bottles.
Figure 4:
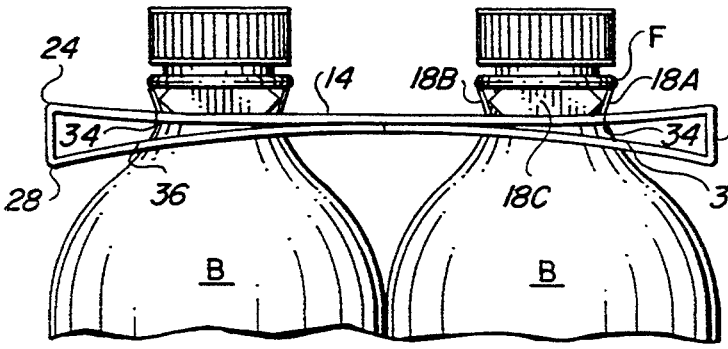
FIG. 4 is an end view of the carrier of FIG. 1, showing the relationship between the carrier elements and the bottles in more detail.

To form a package, the blank is folded along the fold lines 24 and 28, producing an open ended rectangular sleeve, with the ends of the lower support flaps 26 meeting. The sleeve is shown in FIG. 3 as being positioned above a group of six bottles arranged in two rows so that the bottle necks are directly beneath the aligned openings 16 and 38. When the sleeve is pushed down over the tops of the bottles, the upper portions of the bottles move through the openings 38 in the lower support panel flaps and the openings 16 in the upper support panel, pivoting the support tabs 18 up in the process. Relative movement between the bottles and the folded blank continues until the flange F moves above the edges of the tabs, causing the tabs to snap into place so that the tab edges engage the underside of the bottle flanges. This final supporting engagement is shown in FIG. 4.

As the upper support panel is moving relative to the bottle, the bottle engages the edges of the openings 38 in the lower support panel flaps 26. Relative movement between the flaps 26 and the bottles thereby ceases while relative movement between the upper support panel 14 and the bottles continues. The flaps 26 and the support panel 14 thus have relative movement toward each other and are eventually brought into contact with each other at the end portions of the flaps. Because the side panels prevent relative movement of the upper support panel toward the lower support flaps at their outer extremities, they are spaced from each other at the side panels, converging toward each other to a point slightly beyond the outer point on the bottle openings. The upward slope of the upper support panel toward the side panel is facilitated by the fold line 34, and the downward slope of the lower support flaps toward the side panel is facilitated by the fold line 36. The resulting structure at each side of the carrier formed by the side panels and the converging outer portions of the upper support panel and lower support panel flaps functions as support beams or reinforcing ribs, capable of receiving lifting and carrying stresses which are distributed out from the interior of the carrier.

Because the tabs 18A have a greater height than the tabs 18B, the outer edges of the bottle openings 38 are urged down into contact with the bottles, tilting the opposite end of the openings up to a higher position. This produces a general upward bowing of the carrier between the reinforcing ribs. The bowed configuration is increased upon lifting of the carrier, resulting in the outer edge of the bottle openings 38 biting into the bottle more severely and causing the lifting stresses to be distributed out to the reinforcing rib areas. If the outer tabs 18A were not made slightly higher, there would tend to be a gap between the outer tab edges and the bottle flange when the carrier is lifted, with the possible loss of support at this point of the flange.

Figure 5:
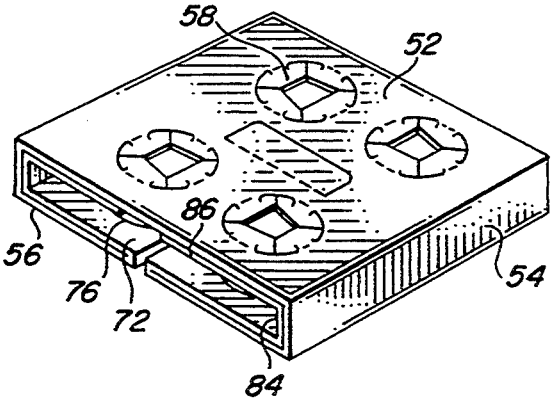
FIG. 5 is a partial plan view of a blank for forming a modified carrier.

Referring now to FIG. 5, a blank 50 for forming a carrier designed to support heavier loads is shown. The blank includes an upper support panel section 52, side panel sections 54 and lower support panel flaps 56 generally similar to the corresponding sections of the blank 32. In this case the carrier is designed to hold four large bottles, and so the upper support panel is provided with four bottle neck openings 58, with associated tabs 59, and a single handle opening 60 for receiving the fingers of a user. Side panel fold lines 62 and 64 correspond to the fold lines 24 and 28 of the first embodiment, while fold lines 66 and 68 in the upper support panel section and lower support panel flaps, respectively, correspond to the fold lines 34 and 36 of the first embodiment. In addition, the lower support panel flaps 56 include bottle openings 70 which function in the same manner as the bottle openings 38 of the first embodiment.

The blank 50 also incorporates several additional sections to reinforce the carrier. Another lower support panel flap 72, which is essentially a mirror image of the flap 56, is connected to the flap 56 by fold line 74. The flap 72 contains bottle neck openings 76 of the same size as the openings 70. In addition, the flaps 56 and 72 include handle opening halves 78 and 80, respectively, which meet at the fold line 74. Connected to the outer edges of the lower support flaps 72 by fold lines 82 are additional side panel sections 84, which in turn are connected to upper support panel reinforcing flaps 86 by fold lines 88. The flaps 86 include bottle neck openings 90 with foldably connected tabs 92, and a cutout 94 at the midpoint of the flap edges. The blank also includes a fold line 96 similar to the fold line 36 of the blank 32.

Figure 6:
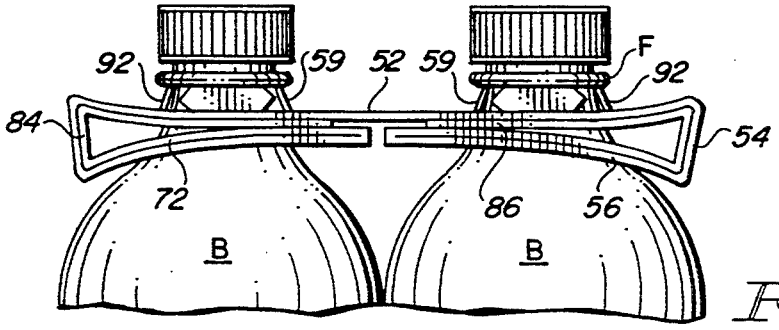
FIG. 6 is a pictorial view similar to that of FIG. 3, but showing the blank of FIG. 5 in folded condition, ready to be lowered into place onto a group of bottles.
Figure 5:
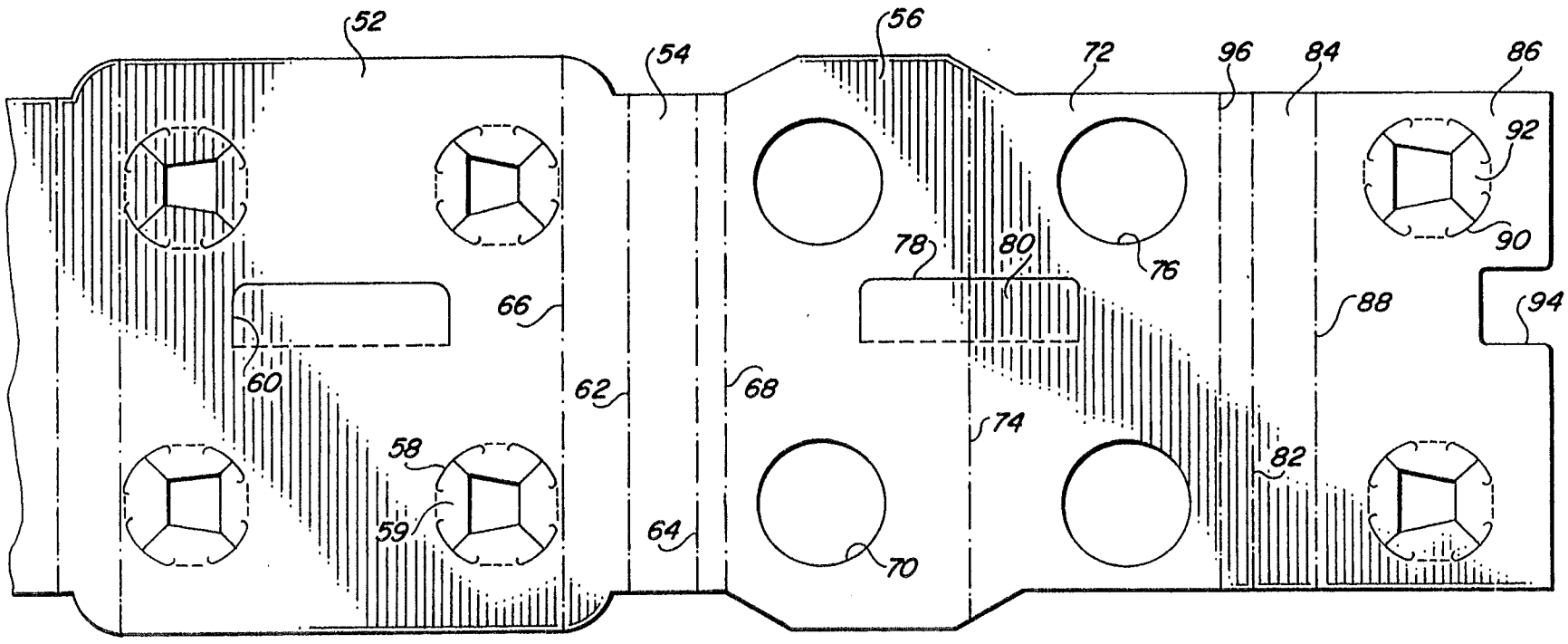

To form a carrier from the blank 50, the lower support flap 72 is folded about fold line 74 so as to lie flat against the underside of the flap section 56. This moves the side panel sections 84 directly beneath the side panel sections 54 and the reinforcing flaps 86 directly beneath the upper support panel section 52. The bottle neck openings 70 and 76 are now aligned, as are the openings 58 and 90. The blank is then folded in the same manner as described in connection with the blank 32, again forming a rectangular sleeve, which in this case is of two-ply construction, as illustrated in FIG. 6. It may be desirable to glue the first and second plies together in order to facilitate the folding of the plies as a unit when forming the rectangular sleeve.

The relative movements of the various elements of the sleeve as the sleeve is pushed down over the tops of the bottles is the same as described in connection with the first embodiment. The result is illustrated in FIG. 7, wherein the stresses and folding action has produced the same wedge-type reinforcing ribs at the edges of the carrier as in the first embodiment, except that in this case the elements are of two-ply construction. Note that while the fold line 96 has been provided to perform the same function as the fold line 36 of the first embodiment, it has not been found necessary to provide a fold line comparable to fold line 34. Such a fold line can also be provided if it is found to be necessary in order to achieve the desired reinforcing rib structure, which can be the case if relatively thick paperboard is employed.

As to the carrier handle, it will be understood that the cutouts or notches 94 at the edges of the reinforcing flaps 86 allow the reinforcing flaps to extend inwardly beyond the ends of the handle openings 60 without interfering with the entry of the fingers of a user. The finger openings 78 and 80 in the lower support panel flaps are preferably covered with foldably connected flaps which are folded back by the user when lifting the carrier. Although this provide additional reinforcing layers at the handle area, the finger opening flaps may be eliminated if it is found that the extra layers of material make it difficult for them to be folded. In either case a finger opening flap would be provided at the opening 60 in the upper support panel 52.

The starburst tabs 92 are shown in FIG. 5 as being aligned the same as the tabs 59 so that the overlying tabs function as a unit. As illustrated, the tabs are mirror images of each other, so that the tab with the greatest height in the upper support panel overlies the tab with the least height in the reinforcing flap. This causes the edges of the other flaps to be angled relative to the edges of the underlying or overlying tabs, which ensures that all of the tab edges engage the shoulders of the associated bottle.

Although the bottles have been shown as having a separate integral flange, the terms flange or shoulder as used in the specification and claims are intended to include the underside of bottle caps in bottles which do not incorporate an integral flange.

It can now be appreciated that the invention provides a unique support carrier capable of carrying heavy loads without failure. The features enabling the carrier to function in this way are incorporated into the carrier without requiring expensive carrier blanks or complicated maneuvers by packaging machines.

The invention is not limited to all the specific details described in connection with the preferred embodiments, except as they may be within the scope of the appended claims. Changes to certain features of the preferred embodiments which do not alter the overall basic function and concept of the invention are therefore contemplated.

What is claimed is:

1. A carrier package, comprising:

two rows of bottles, each bottle having a neck portion extending up from a wider body portion, the neck portion including an outwardly projecting shoulder;

opposite side panels having upper and lower edges;

an upper support panel having a width extending between opposite side edges, the upper support panel being connected along fold lines at said opposite side edges to the upper edges of the side panels;

a lower support panel flap connected along a fold line to the lower edge of each side panel;

the upper support panel and the lower support panel flaps containing openings through which the necks of the bottles extend, the wider portion of the bottles contacting the edges of the openings in the lower support panel flaps;

a plurality of support tabs connected to the upper support panel by fold lines extending along portions of the periphery of each bottle opening, the support tabs having edges for engaging the underside of the bottle shoulders; and the portions of the upper support panel between the openings therein and the side panels being upwardly angled with respect to the portion of the upper support panel between the rows of bottles and the portion of each lower support panel flap between the openings therein and the associated side panel being downwardly angled with respect to the portion of the upper support panel between the rows of bottles, the lower support panel flaps having end portions in contact with the upper support panel between the rows of bottles, whereby the side panels and adjacent portions of the upper panel and the lower support panel flaps function as reinforcing ribs.

2. A carrier package according to claim 1, wherein the upper support panel includes a fold line between each side panel and the adjacent row of openings, the fold lines being substantially parallel to the side panels.

3. A carrier package according to claim 2, wherein the lower support panel flaps include a fold line between each side panel and the adjacent row of openings, the fold lines being substantially parallel to the side panels.

4. A carrier package according to claim 1, wherein the upper support panel includes handle openings.

5. A carrier package according to claim 4, wherein the end portions of the lower support panel flaps contain handle cutouts aligned with the handle openings in the upper support panel.

6. A carrier package according to claim 1, wherein one of the support tabs at each bottle opening is closer to the nearest side panel than the other support tabs at said bottle opening, said one support tab being connected to the upper support panel by a fold line which is substantially parallel to the side panels, the height of said one support tab being greater than the height of an opposite support tab at said bottle opening.

7. A carrier package according to claim 6, wherein the edges of said one support tab and said opposite support tab are substantially parallel to the fold lines connecting said support tabs to the upper support panel.

8. A carrier package according to claim 7, wherein the support tabs at each bottle opening include intermediate tabs located between said one support tab and said opposite support tab, the edge of said one support tab being shorter than the edge of said opposite support tab.

9. A carrier according to claim 1, wherein the lower support panel flaps are comprised of an upper ply and a lower ply, the lower ply being connected to the lower edge of the side panels and the upper ply being connected to the lower ply along a fold line extending substantially parallel to the side panels.

10. A carrier according to claim 9, wherein the side panels are comprised of an outer ply and an inner ply, the outer ply being connected to the upper support panel and to the lower ply of the associated lower support panel flap, and the inner ply being connected to the upper ply of the associated lower panel flap along a fold line substantially parallel to the side panels.

11. A carrier according to claim 10, including reinforcing strips connected along fold lines to the inner plies of the side panels, the reinforcing strips including bottle openings aligned with the bottle openings in the upper support panel.

12. A carrier according to claim 11, including a plurality of support tabs connected to the reinforcing strips by fold lines extending along portions of the periphery of each bottle opening therein, the support tabs having edges for engaging the underside of the bottle shoulders.

13. A carrier according to claim 12, wherein adjacent support tabs of each bottle opening in the upper support panel are of different size or shape, the support tabs of the aligned bottle openings in the reinforcing strips being similar in size and shape to the support tabs of the upper support panel.

* * * * *